United States Patent [19]

Waizmann

[11] 4,232,604

[45] Nov. 11, 1980

[54] RUBBER BLANKET CLEANING DEVICE

[75] Inventor: Franz Waizmann, Steppach, Fed. Rep. of Germany

[73] Assignee: Firma Baldwin-Gegenheimer GmbH, Augsburg, Fed. Rep. of Germany

[21] Appl. No.: 3,231

[22] Filed: Jan. 15, 1979

[30] Foreign Application Priority Data

Feb. 4, 1978 [DE] Fed. Rep. of Germany ..... 2804786

[51] Int. Cl.[3] ..... B41F 35/00

[52] U.S. Cl. ..... 101/425

[58] Field of Search ..... 101/425, 423, 142, 148; 15/256.51, 256.52

[56] References Cited

U.S. PATENT DOCUMENTS

| | | | |
|---|---|---|---|
| 693,044 | 2/1902 | Miehle | 101/423 |
| 3,120,805 | 2/1964 | Simon | 101/425 |
| 3,164,087 | 1/1965 | Owen | 101/425 X |
| 3,463,082 | 8/1969 | Kaufer | 101/425 X |
| 3,467,011 | 9/1969 | Phleps et al. | 101/425 |
| 3,796,183 | 3/1974 | Thetiu | 101/425 |
| 3,835,779 | 9/1974 | Ross et al. | 101/425 |
| 3,874,394 | 4/1975 | Robertson | 101/425 X |
| 3,957,423 | 5/1976 | Mueller | 101/425 |
| 3,976,007 | 8/1976 | Junghans et al. | 101/425 |
| 4,090,445 | 5/1978 | Sassi | 101/425 |

FOREIGN PATENT DOCUMENTS

| | | | |
|---|---|---|---|
| 2538067 | 9/1974 | Fed. Rep. of Germany | 101/425 |
| 2285997 | 9/1975 | France | 101/425 |

*Primary Examiner*—E. H. Eickholt
*Attorney, Agent, or Firm*—Max Fogiel

[57] ABSTRACT

To effectively counteract any deformation of the pressing roller of a rubber blanket cleaning device for offset printing machines, a cleaning blanket is passed over the pressing roller and a blanket is brought into contact with the rubber cylinder. To improve the cleaning process, a pressing roller support is arranged at the periphery of the pressing roller, whose outer contour can, in non-loaded state, pass by the roller-side surface of the pressing roller support free from pressure and play. The pressing roller support is positioned parallel to the axis of the pressing roller and approximately diametrically opposite to the arc region, while coming into contact with the pressing roller of the rubber cylinder.

4 Claims, 2 Drawing Figures

RUBBER BLANKET CLEANING DEVICE

The invention relates to a rubber blanket cleaning device for offset printing machines, where a cleaning blanket is passed over a pressing roller and said blanket is brought into contact with the rubber cylinder to be cleaned by means of said pressing roller.

Arrangements of this nature have on the whole proved satisfactory and guarantee a simple and orderly cleaning process. It has, however, been found that the pressing roller, which extends over the entire width of the machine and is only mounted at its ends, is deformed in its middle region as a result of the pressure exerted against the rubber cylinder to be cleaned. The danger consequently arises that on sudden relief, as e.g. on passing through the cylinder groove, the pressing roller will be caused to vibrate, with the result that the pressing roller and thus also the cleaning blanket passed around it now and then lose contact with the rubber cylinder to be cleaned and consequently, especially in the region of the rubber cylinder groove edges, dirty streaks are left.

Starting from this, it is the object of the present invention, using simple means involving little expense, to effectively counteract any deformation of the pressing roller when using rubber blanket cleaning devices of the sort mentioned at the beginning, thus further improving the cleaning process.

This objective is established in surprisingly simple manner according to the invention by means of a pressing roller support at the surface of the pressing roller, which in non-loaded state can pass by free from pressure and play, where said pressure roller support is positioned parallel to the axis of said pressing roller and diametrically opposite to the rubber cylinder arc region coming into contact with the pressing roller. The additional support effected here for the pressing roller prevents the latter from undergoing a deformation directed away from the rubber cylinder to be cleaned. On the other hand, however, it is advantageous that pressure is only exerted on the pressing roller by the support for as long as the pressing roller would normally undergo deformation in the absence of the pressing roller support according to the invention. The pressing roller has furthermore a clearance of up to a so-called kiss-contact from the support, so that no friction between pressing roller and pressing roller support need be feared and any cleaning liquid there might be on the pressing roller is not wiped or spun off. The measures according to the invention accordingly guarantee altogether short cleaning times.

A particularly advantageous and expedient further development of the measures described above can consist in a metal supporting plate which embraces the pressing roller in troughlike manner being provided as pressing roller support. This assures that deformations in different directions can also be sustained without having to adjust the pressing roller support, thus lending a high degree of variability with respect to the different printing machine constructions. At the same time the pressure transferred to the pressing roller is in this manner taken up over a relatively large surface area, so that the pressing roller support doesn't in practice penetrate into the pressing roller surface, which as a rule is designed to yield.

Further features and advantages of the invention are evident from the following description of a particularly preferred embodiment of the invention, with the help of the drawings and in conjunction with the remaining subclaims:

Figure 1:
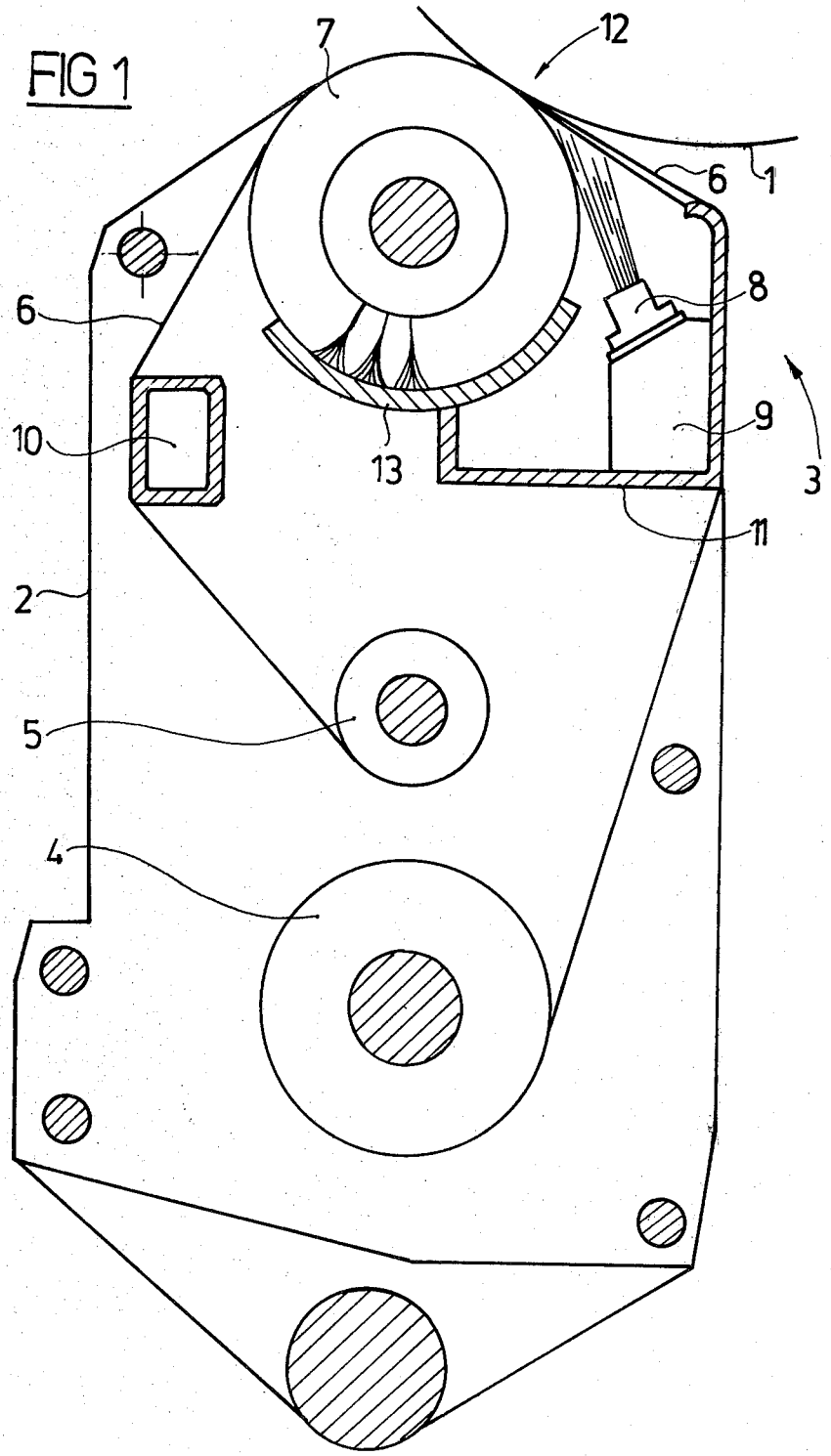
FIG. 1 shows a general view of a rubber blanket cleaning device in section.

In FIG. 1 the rubber cylinder of an offset printing machine, not illustrated in greater detail, is designated by 1, associated with which is a cleaning device designated as a whole by 3 and bounded by lateral bearing plates 2. The cleaning device operates with a cleaning blanket 6, which is gradually rolled off a storage drum 4 and onto a take-up drum 5 and which is passed around a pressing roller 7 opposite to the rubber cylinder 1. For supplying the cleaning blanket 6 with cleaning liquid, e.g. water, a moistening device is provided which, in the embodiment shown, consists of a nozzle holder 9 with spraying nozzles 8. As can be clearly seen from FIG. 1 this is expediently situated within the space bounded by the cleaning blanket 6, said space being practically enclosed by the cleaning blanket 6 and thus affording the neighbouring machine parts excellent protection from being wetted by the spray nozzles 8. At the same time this guarantees that the cleaning blanket 6, when being changed, can be inserted simply in the form of an enveloping coat, which is extremely easy for the operator. Traverses 10 and 11 are provided to guide the cleaning blanket 6. The guide traverses can be connected with the lateral bearing plates 2 for formation of a stable framework. Traverse 11 serves simultaneously as mounting for the nozzle holder 9 and uptake bracket for any cleaning fluid which might drip.

The bearing plates 2 are swingably suspended in the frame of the printing machine, not shown in more detail, in such a way that the pressing roller 7, held by the printing machine, can be swung to and away from the rubber cylinder 1. In the embodiment shown the pressing roller 7 should be designed as a brush roller, this advantageously guaranteeing excellent contact between the surface of the roller and the surface to be cleaned. As soon as the pressing roller 7 is swung against the rubber cylinder 1 to be cleaned, a relatively wide contact zone, shown by 12, is formed in advantageous manner. In order to avoid deformations of the pressing roller 7, which is mounted only at its ends in the lateral bearing plates 2, due to the pressure transferred in the contact zone 12 to the pressing roller 7, a pressing roller support 13 is provided which is positioned approximately diametrically opposite to the contact zone 12 and which runs approx. parallel to the axis of pressing roller 7, so affording the latter the necessary rigidity. In the particularly preferred embodiment shown the pressing roller support 13 comprises a metal supporting plate which embraces the pressing roller 7 in troughlike manner and which, in non-loaded state, is positioned in so-called kiss-contact with the outer contour of pressing roller 7. The latter passes by the roller-side surface of the supporting plate constituting the pressing roller support 13 free from pressure and play, so that liquid taken up by the bristles of the brush roller constituting pressing roller 7 is not wiped off. In the embodiment shown the supporting plate acting as pressing roller support 13 encircles the pressing roller 7 over a relatively large peripheral area, expediently measuring about 120° to 180°; this results in excellent bracing over a large area, advantageously insensitive to any change in direction of the pressure exerted on the pressing roller 7. In this way maximum independence of the structural features of individual printing machines is advantageously attained, which, with respect to functional efficiency, makes very desirable standardization possible and renders corresponding circumferential adjustment to the pressing roller support unnecessary.

Figure 2:
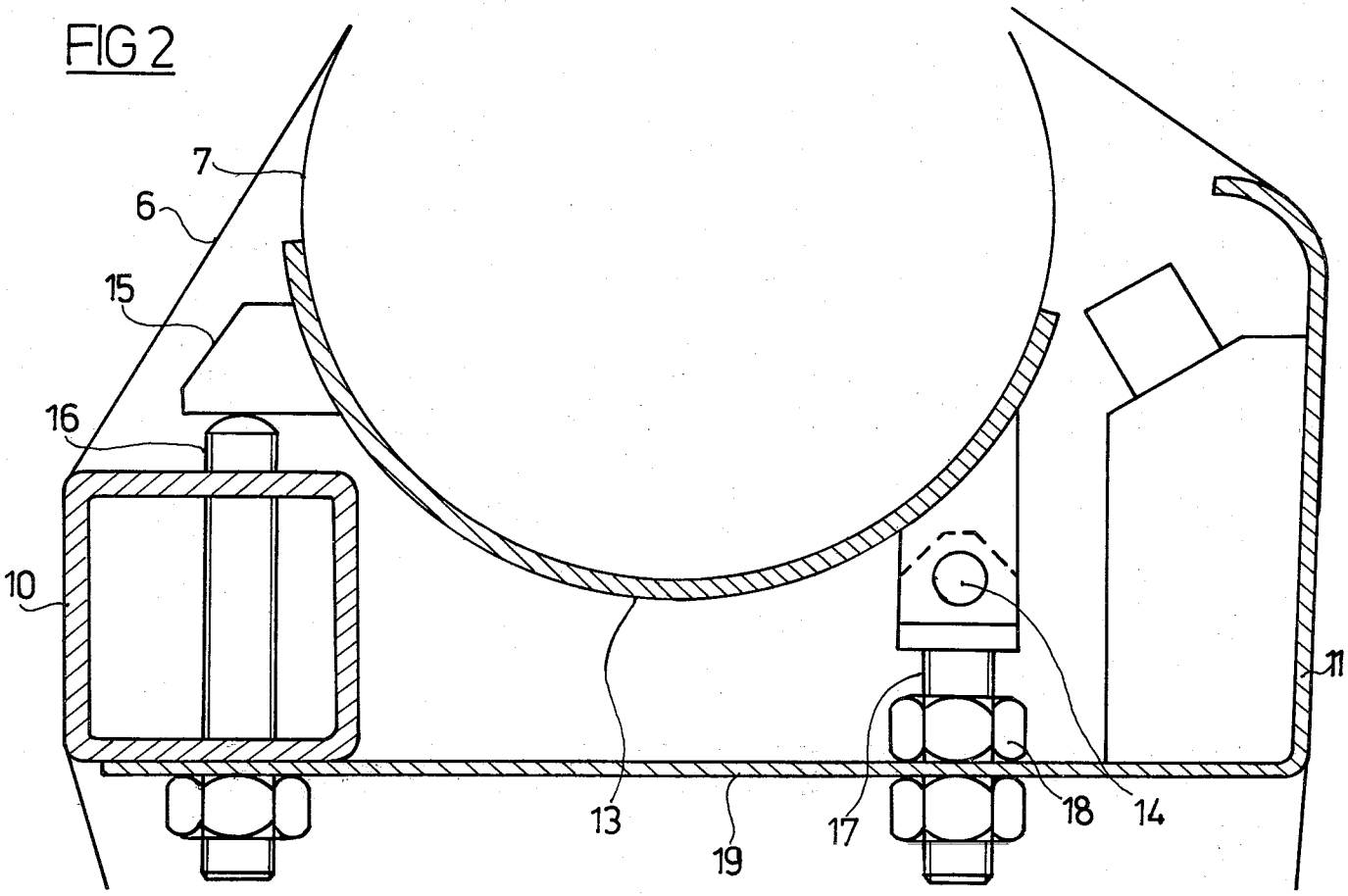
FIG. 2 shows, enlarged as compared with FIG. 1, a particularly preferred embodiment of the roller support according to the invention.

It is expedient if the supporting plate constituting the pressing roller support 13 is adjustably suspended opposite the pressing roller 7. For this the supporting plate, as can be clearly seen from FIG. 2, is suspended on one side on vertically-adjustable mountings 14 and on the other side by means of corresponding projections 15 on adjusting screws 16. It is expedient if several adjusting screws 16 are arranged adjacently over the length of the supporting plate constituting the pressing plate support 13 as this makes exact zonal adjustment possible. In the embodiment shown the adjusting screws 16 are mounted simply on the guide traverse 10. Mountings 14 are here provided simply with headless screws 17 which are secured by counter nuts 18 to a support, here simply a bar 19 connecting guide traverses 10 and 11.

The supporting plate forming the pressing plate support 13 can extend over the entire length of the pressing roller 7. As tests have shown, however, it is sufficient if the supporting plate extends only over a middle region of pressing roller 7. In this way one standard size can advantageously be used for all machine widths. A supporting plate of about 60 cm has proved to be particularly expedient.

In the foregoing description a particularly preferred embodiment of the invention has been explained in detail; this should not, however, infer any limitation. An expert has much rather a series of possibilities at his disposal for adapting the general thinking of the invention to the conditions prevailing in individual cases.

I claim:

1. Rubber blanket cleaning device for offset printing machines, where a cleaning blanket is passed over a pressing roller and said blanket is brought into contact with the rubber cylinder to be cleaned by means of said pressing roller, characterized by a pressing roller support (13) at the periphery of the pressing roller (7), whose outer contour can, in non-loaded state, pass by the roller-side surface of said pressing roller support (13) free from pressure and play, the pressing roller support (13) being positioned parallel to the axis of said pressing roller and approximately diametrically opposite to the arc region (12), coming into contact with the pressing roller, of rubber cylinder (1).

2. Rubber blanket cleaning device according to claim 1, characterized in that the pressing roller support (13) is adjustably mounted opposite the pressing roller (7).

3. Rubber blanket cleaning device according to claim 1, characterized in that the pressing roller support (13) is limited lengthwise to a mean central section.

4. Rubber blanket cleaning device according to claim 1, characterized in that for formation of the pressing roller support (13) a metal supporting plate is provided which embraces pressing roller (7) in troughlike manner.

* * * * *